US007377809B2

(12) United States Patent
Dyck

(10) Patent No.: US 7,377,809 B2
(45) Date of Patent: May 27, 2008

(54) COAXIAL CONNECTOR WITH MAXIMIZED SURFACE CONTACT AND METHOD

(75) Inventor: Arthur Dyck, Abbotsford (CA)

(73) Assignee: Extreme Broadband Engineering, LLC, Millstone Township, NJ (US)

( * ) Notice: Subject to any disclaimer, the term of this patent is extended or adjusted under 35 U.S.C. 154(b) by 0 days.

(21) Appl. No.: 11/725,764

(22) Filed: Mar. 20, 2007

(65) Prior Publication Data

US 2007/0243771 A1 Oct. 18, 2007

Related U.S. Application Data

(60) Provisional application No. 60/792,304, filed on Apr. 14, 2006.

(51) Int. Cl.
*H01R 9/05* (2006.01)

(52) U.S. Cl. ..... 439/578; 439/593

(58) Field of Classification Search ..... 439/578, 439/675, 593
See application file for complete search history.

(56) References Cited

U.S. PATENT DOCUMENTS

| | | | | |
|---|---|---|---|---|
| 3,124,406 | A * | 3/1964 | Cook | 439/320 |
| 3,336,563 | A * | 8/1967 | Hyslop | 439/603 |
| 3,725,853 | A | 4/1973 | McKeown et al. | 339/252 R |
| 3,828,305 | A * | 8/1974 | Hogendobler | 439/585 |
| 4,445,739 | A | 5/1984 | Wooten | 439/141 |
| 4,561,716 | A | 12/1985 | Acke | 339/177 R |
| 4,799,902 | A * | 1/1989 | Laudig et al. | 439/585 |
| 4,897,045 | A | 1/1990 | Dyck | 439/578 |
| 5,044,990 | A * | 9/1991 | Knotts | 439/578 |
| 5,096,444 | A | 3/1992 | Lu et al. | 439/750 |
| 5,417,588 | A * | 5/1995 | Olson et al. | 439/585 |
| 5,439,386 | A * | 8/1995 | Ellis et al. | 439/322 |
| 5,462,459 | A | 10/1995 | Childs | 439/843 |
| 5,474,459 | A | 12/1995 | Su | 439/106 |
| 5,676,570 | A | 10/1997 | Scherer | 439/787 |
| 5,704,799 | A | 1/1998 | Wood | 439/281 |
| 5,752,839 | A | 5/1998 | Fiacco et al. | 439/63 |
| 5,775,927 | A * | 7/1998 | Wider | 439/188 |
| 5,865,654 | A | 2/1999 | Shimirak et al. | 439/852 |
| 5,967,852 | A * | 10/1999 | Follingstad et al. | 439/675 |

(Continued)

*Primary Examiner*—Tulsidas C. Patel
*Assistant Examiner*—Vladimir Imas
(74) *Attorney, Agent, or Firm*—Watov & Kipnes, P.C.; Kenneth Watov

(57) ABSTRACT

A female coaxial cable electrical connector includes an electrically conductive barrel or shell enclosing a contact carrier assembly. The contact carrier assembly consists of a cap member enclosing a subassembly that includes an elastomeric sleeve or tubing compressively but yieldably mounted over the contact receiving arms of a base member with an electrical contact secured between opposing ones of the two contact receiving arms. The electrical contact is formed from electrically conductive material, and includes two opposing half-sections that are mounted between the contact receiving arms of the base, and have side wing portions contacting one another, with opposing longitudinal semicircular grooves of the half-sections of the contact together forming a circular pathway for receiving a male electrical pin or the center conductor of a coaxial cable. When such a pin or center conductor is inserted into the electrical contact, the elastomeric sleeve initially yields on inward pressure to permit insertion of the pin, while maintaining sufficient inward pressure to force the semicircular grooves of the electrical contact to mechanically contact and surround the circumference of the male pin or center conductor, for substantially the full length of its insertion, thereby insuring a low resistance electrical contact therebetween.

20 Claims, 11 Drawing Sheets

U.S. PATENT DOCUMENTS

| | | | | |
|---|---|---|---|---|
| 6,299,479 | B1 | 10/2001 | Tang | 439/581 |
| 6,309,251 | B1 | 10/2001 | Tang | 439/578 |
| 6,336,832 | B2 | 1/2002 | Nobe | 439/857 |
| 6,796,829 | B1 * | 9/2004 | McCarthy | 439/394 |
| 6,884,115 | B2 * | 4/2005 | Malloy | 439/584 |
| 6,890,208 | B2 * | 5/2005 | McCarthy | 439/394 |
| 6,899,563 | B1 * | 5/2005 | Lee | 439/578 |
| 6,910,925 | B2 | 6/2005 | Endo et al. | 439/856 |
| 7,014,502 | B2 * | 3/2006 | Rasmussen | 439/578 |
| 7,252,560 | B2 * | 8/2007 | Wendland et al. | 439/851 |
| 2001/0004568 | A1 | 6/2001 | Kikuchi et al. | 439/857 |
| 2001/0014561 | A1 | 8/2001 | Endo et al. | 439/857 |
| 2002/0022413 | A1 | 2/2002 | Ching-Shan Yeh | 439/857 |

* cited by examiner

COAXIAL CONNECTOR WITH MAXIMIZED SURFACE CONTACT AND METHOD

RELATED APPLICATION

This Application is related to now abandoned Provisional Application No. 60/792,304 filed on Apr. 14, 2006, the teachings of which are incorporated herein to the extent that they do not conflict herewith. The present Application has common ownership and inventorship with the related Application.

FIELD OF THE INVENTION

The present invention relates generally to the electrical connectors, and more particularly to electrical connectors for use with coaxial cable.

BACKGROUND OF THE INVENTION

Substantial research and development have been conducted for many years to provide electrical connectors for use with coaxial cables that insure reliable electrical and mechanical connection between the coaxial cable and the connector. Although many improvements have been made, there is still a need in the art to provide an electrical connector of extreme reliability for insuring ease of mechanical interconnection with the coaxial cable, in addition to the maintenance of an extremely low impedance electrical connection between the center conductor of the coaxial cable and the connector.

SUMMARY OF THE INVENTION

The present connector includes a centrally located split halves electrical contact for substantially completely surrounding along their full length the male pin or center conductor associated with a coaxial cable The electrical contact opposing halves are carried within a dielectric contact carrier partially surrounded by an elastomeric sleeve carrier for imparting a radial pressure against bendable arms of the contact carrier, for forcing the split halves of the electrical contact into encircling contact with the center conductor of the coaxial cable for insuring a high integrity mechanical contact with substantially low resistance electrical connection therebetween.

BRIEF DESCRIPTION OF THE DRAWINGS

The various embodiments of the present invention are described below with reference to the drawings, in which like items are identified by the same reference designation, wherein.

DETAILED DESCRIPTION OF THE INVENTION

Figure 1A:
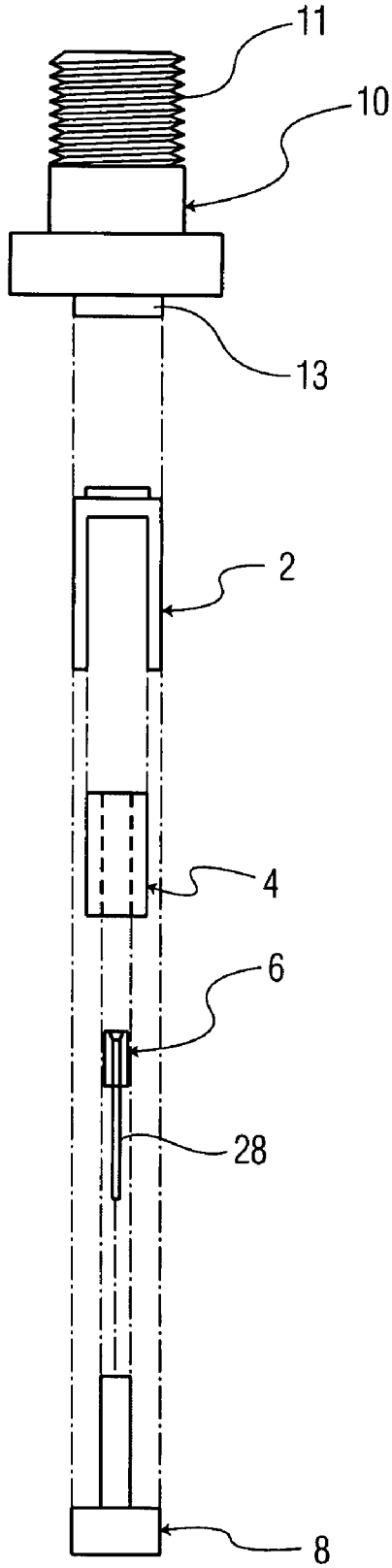
FIG. 1A is an exploded assembly view of the present connector for one embodiment of the invention.
Figure 1B:
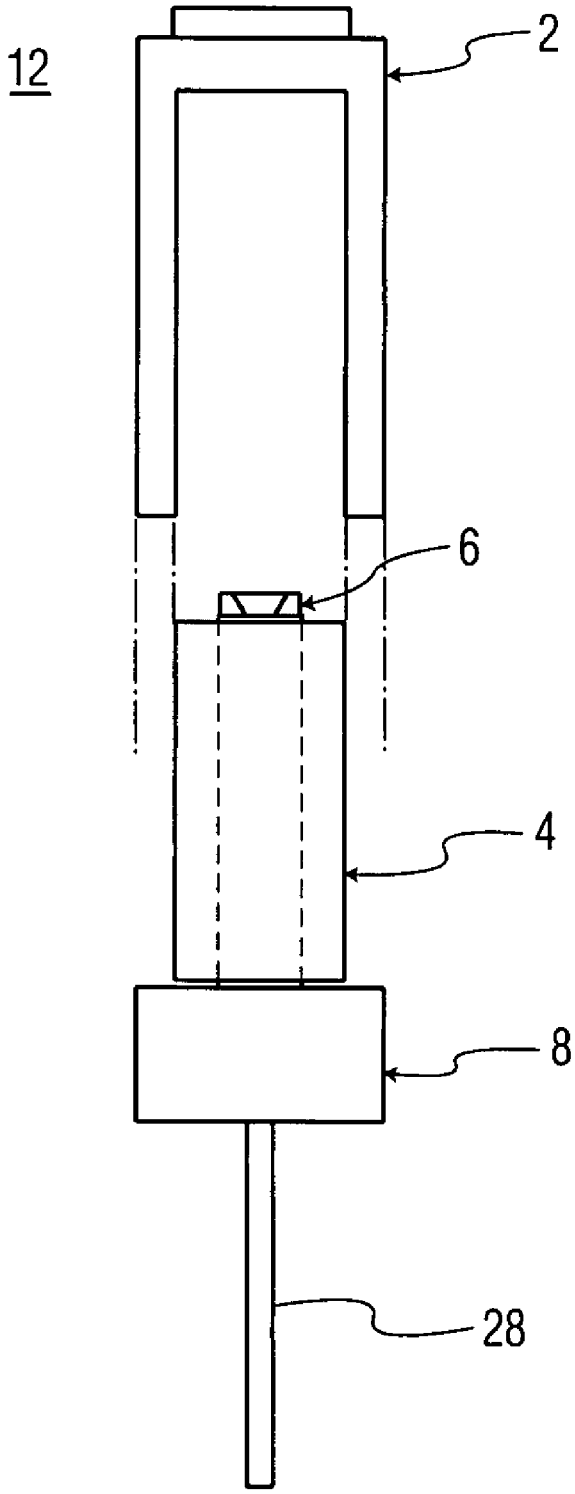
FIG. 1B is a partial assembled and partial exploded assembly view of a female electrical contact member assembled to a base member with a silicone tubing sleeve secured over the base member, and a cap member in position to be inserted thereon.
Figure 1C:
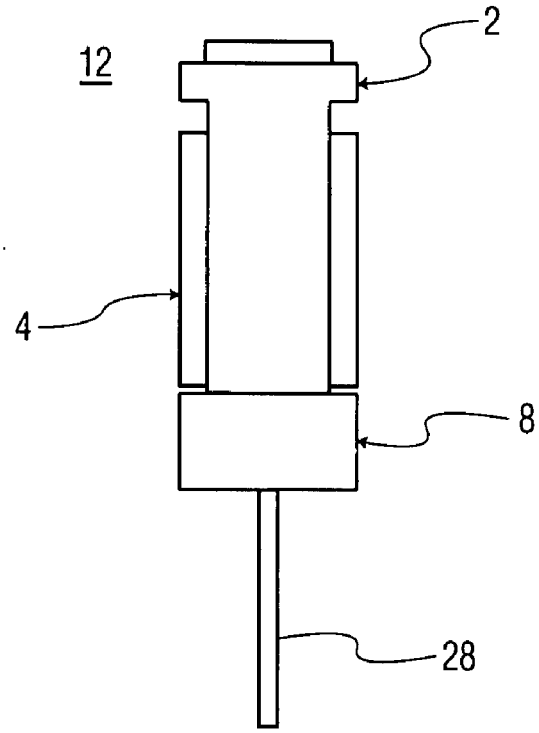
FIG. 1C shows the completion of the partial assembly view of FIG. 1B.
Figure 1D:
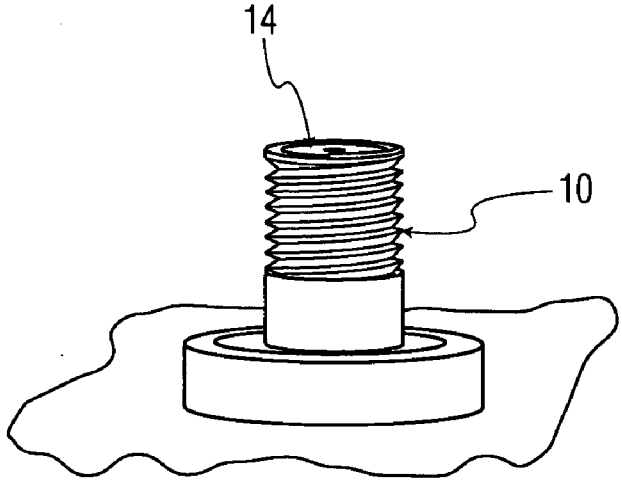
FIG. 1D shows the completion of the assembly of FIG. 1C into a connector shell or housing.
Figure 2A:
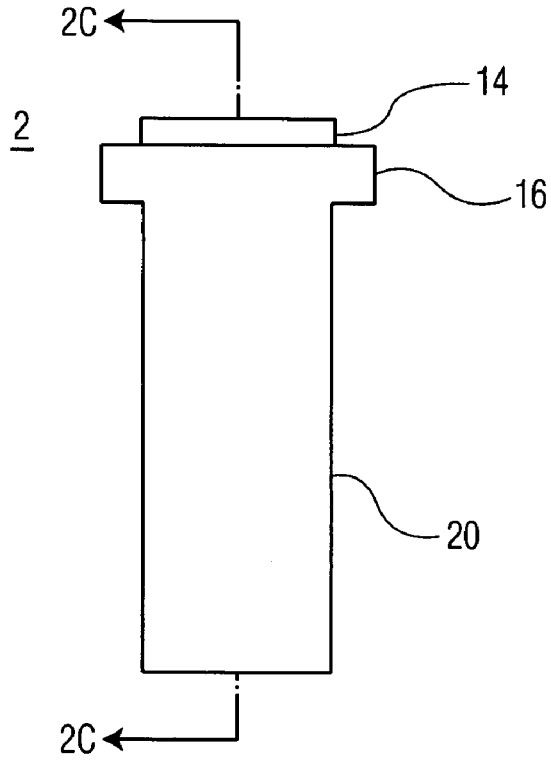
FIG. 2A is a right-side elevational view of the cap member, the left-side elevational view being identical thereto.
Figure 2B:
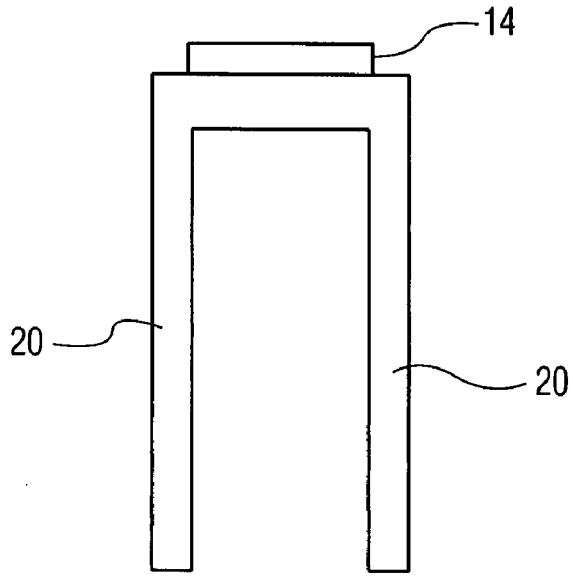
FIG. 2B is a front elevational view of the cap member, the back elevational view being identical thereto.
Figure 2C:
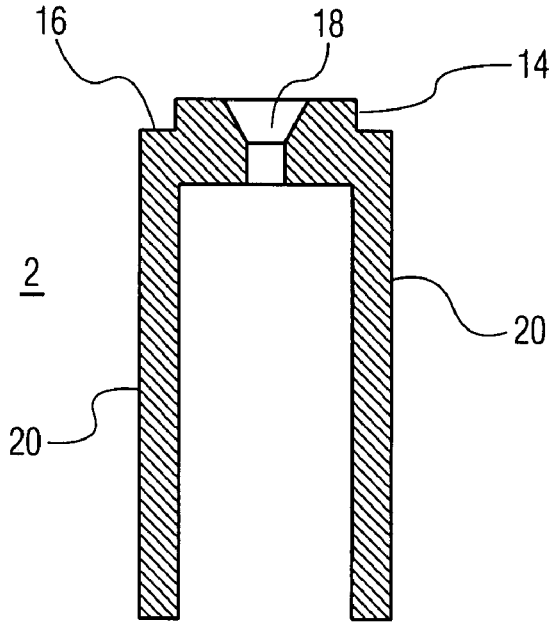
FIG. 2C is a cross-sectional view taken along to 2C-2C of FIG. 2A.
Figure 2D:
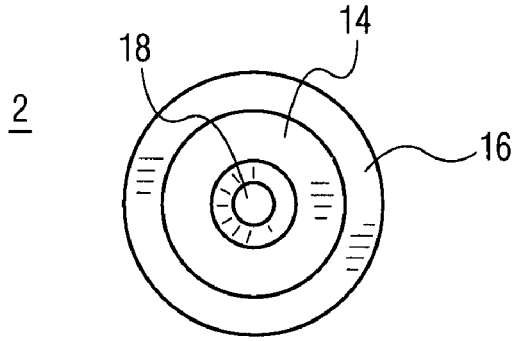
FIG. 2D is a top plan view of the cap member.
Figure 2E:
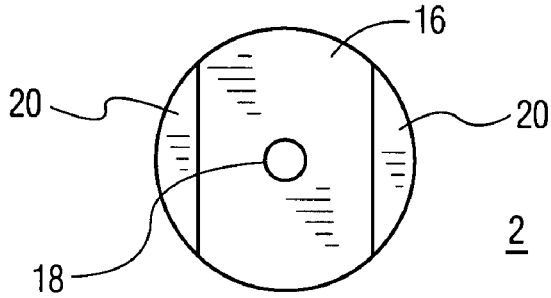
FIG. 2E is a bottom plan view of the cap member, this view in association with the views of FIGS. 2A through 2D, representing an embodiment of the invention.

With reference to FIGS. 1A through 1D, the present female coaxial connector includes the assembly of a cap 2, an elastomeric sleeve 4, an electrical contact 6, a base member 8, and a coaxial cable connector shell 10 having a peening collar 13 and threads 11. In FIG. 1B, a partial subassembly of the present connector shows installation of the electrical contact 6 within the base member 8, with the elastomeric sleeve 4 installed over a portion of the base member 8, and with the cap 2 being positioned for later installation for the aforesaid partial subassembly. The completed subassembly is shown in FIG. 1C, with the cap 2 installed over the sleeve 4, and base member 8. Note that the completed subassembly of FIG. 1C is rotated 90° relative to the partial subassembly view of FIG. 1A. The completed subassembly 12 is mounted within an electrically conductive barrel or shell 10, as shown in FIG. 1D. As shown in FIG. 1B, the sleeve 4 is installed with its top end even with the top of base 8. One application for the present coaxial connector is to provide an F-port connector configured for accommodating RG6 or RG59 coaxial cable, but is not so limited, and can be utilized with other port sizes and coaxial cable configurations. Also note further that the contact assembly 12 mounted within the port or connector shell 10 has an uppermost reduced diameter portion 14 of the cap 2 (see FIGS. 2A-2E, as described below).

Various features of the cap 2 will now be described with reference to FIG. 2A through 2E. The cap 2 consists of a single piece of appropriate dielectric plastic material. As shown, cap 2 includes a reduced diameter top most portion 14 concentric with a relatively increased diameter underlying circular top portion 16. The centrally located countersunk through hole 18 is provided through the top portions 14, 16, respectively, as shown. Extending downward from the top portion 16 are two opposing relatively narrow width side members 20, with the space therebetween dimensioned to permit the cap to be snugly retained over the sleeve 4 and base member 8. Each of the side members 20 have a radial horizontal cross-section.

Figure 3A:
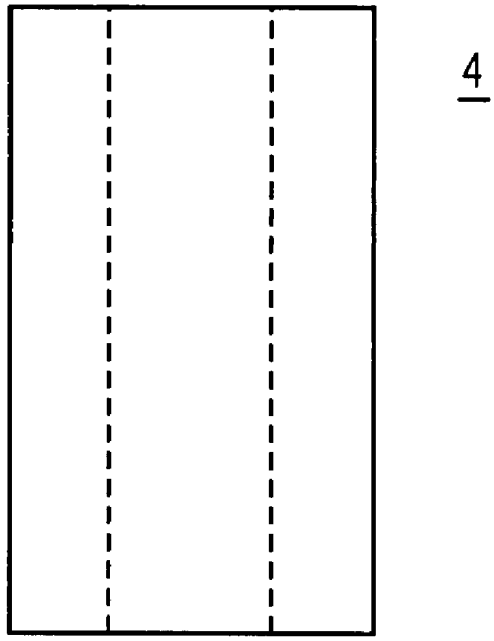
FIG. 3A is a front elevational view of a circular silicone sleeve for an embodiment of the invention.
Figure 3B:
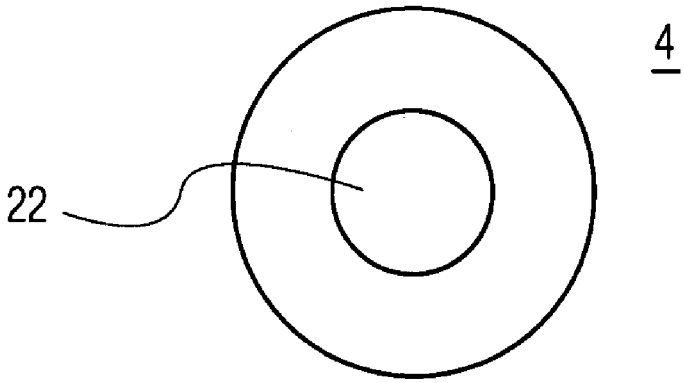
FIG. 3B is a top plan view of the sleeve of FIG. 3A.

The sleeve 4 as shown in FIGS. 3A and 3B, in this embodiment consists of silicone tubing material, but can be made from any suitable elastomeric material. The sleeve 4 includes a centrally-located circular through hole 22, which is dimensioned to compressively slide onto base member 8, as will be further described below.

Figure 4A:
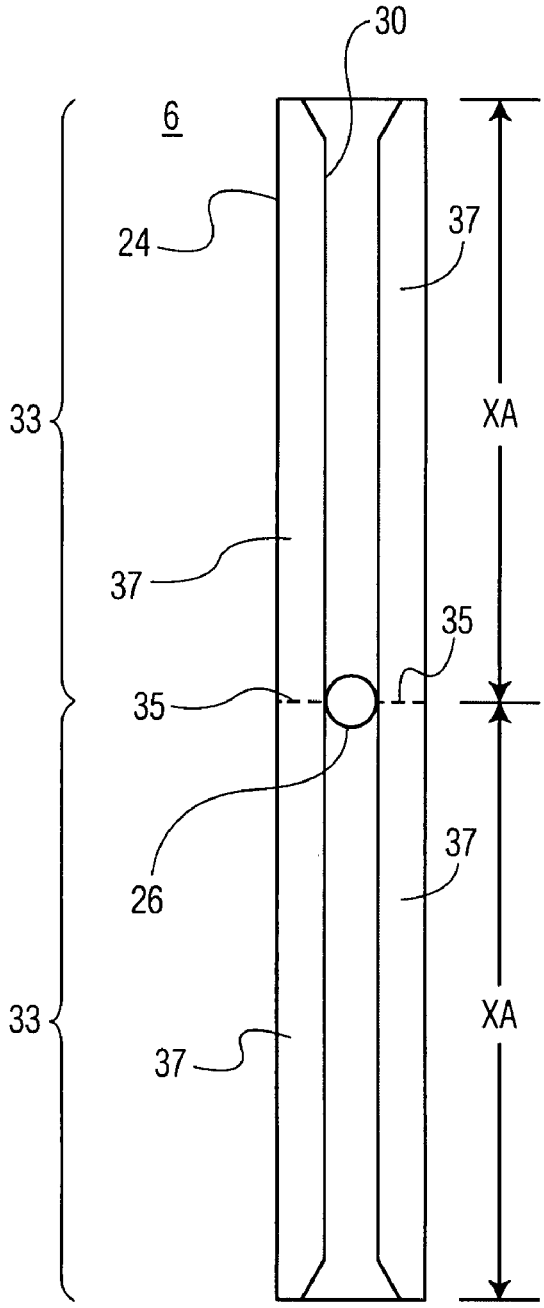
FIG. 4A is a top plan view of a blank form of an electrical contact before folding in half for one embodiment of the invention.
Figure 4B:
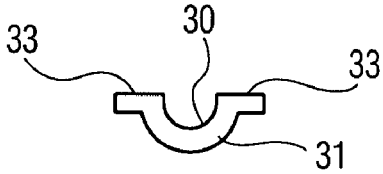
FIG. 4B is a top view of the contact of FIG. 4A.
Figure 4E:
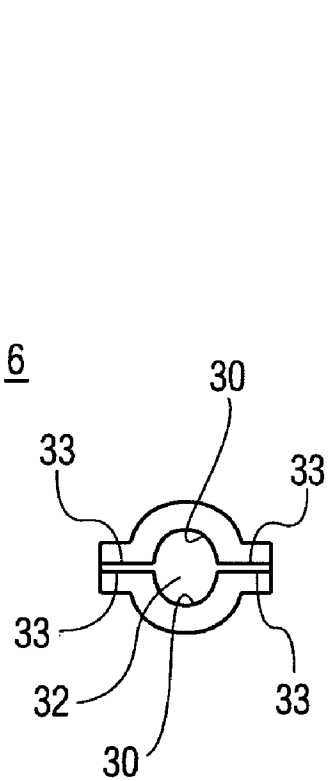
FIG. 4E is a top plan view of the assembled electrical contact.
Figure 4D:
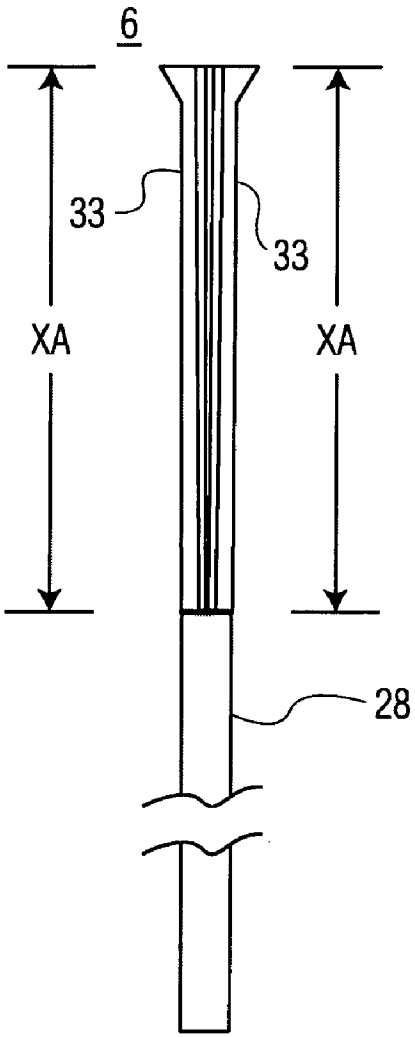
FIG. 4D is a pictorial view of the assembled electrical contact with an electrical conductor.
Figure 4C:
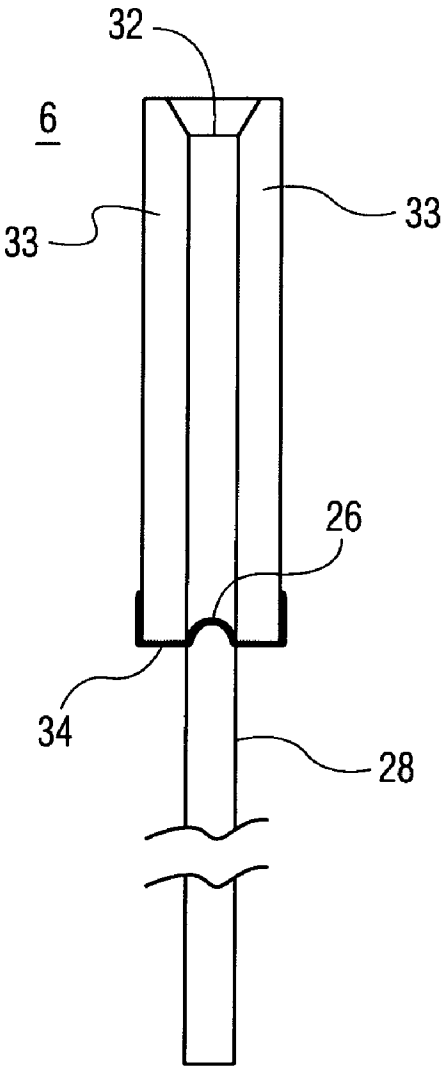
FIG. 4C shows a front elevational view of the assembly of the folded electrical contact of FIG. 4A as assembled to a wire or electrical conductor.

Electrical contact 6, configured to provide a substantially tubular female contact member, is fabricated from appropriate material, such as beryllium copper (BeCu). This material is preferred, but other suitable contact materials can be utilized. To form the contact 6, a blank 24 of BeCu material is configured to have a centrally located hole 26 for receiving an electrically conductive wire 28 (see FIG. 4C). The blank 24 is formed to include a centrally located longitudinal semicircular groove or channel 30. The blank 24 is folded in half along fold line 35 to have the semicircular grooves 30 of each half 33 opposing one another. Side-wings 37 are formed on opposite sides of the grooves 30. Note that the half-sections 33 of the blank 24 are identical, and have equal lengths XA, respectively. FIG. 4E is a top view showing two half-sections 33 opposing one another, and forming a substantially circular open groove or pathway 32. In FIG. 4C the assembled contact 6 is shown with an end of an electrically conductive wire 28 being soldered or electronically welded, or otherwise both mechanically and electrically connected within the hole 26 now located at the bottom of the formed electrical contact 6. A pictorial view of the completed electrical contact 6 is shown in FIG. 4D. Note in this example that in the preferred embodiment the thickness of the BeCu material for contact 6 is 0.002 inch, but it is not so limited in that through use of other materials or in other applications the thickness may be otherwise. Also, in this example, solder 34 is shown for securing the wire 28 to the contact 6.

Figure 5A:
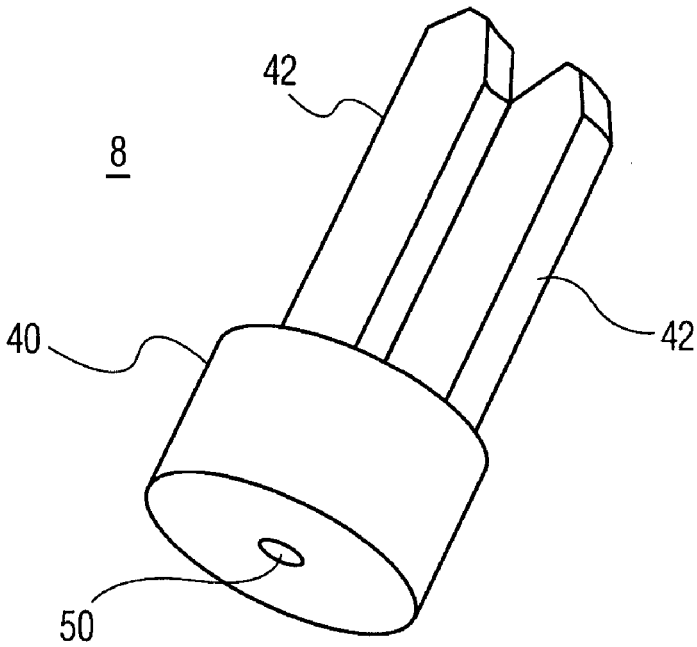
FIG. 5A is a pictorial view of a portion of a base member for one embodiment of the invention.
Figure 5B:
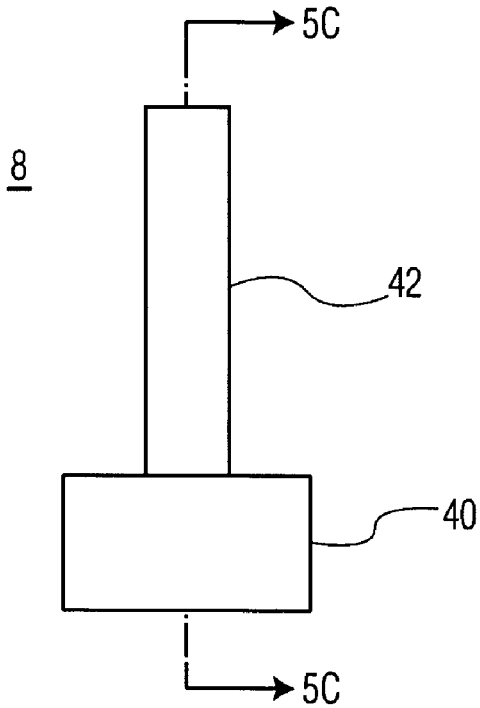
FIG. 5B is a right-side elevational view, the left-side being identical therewith, of the base member of FIG. 5A.
Figure 5C:
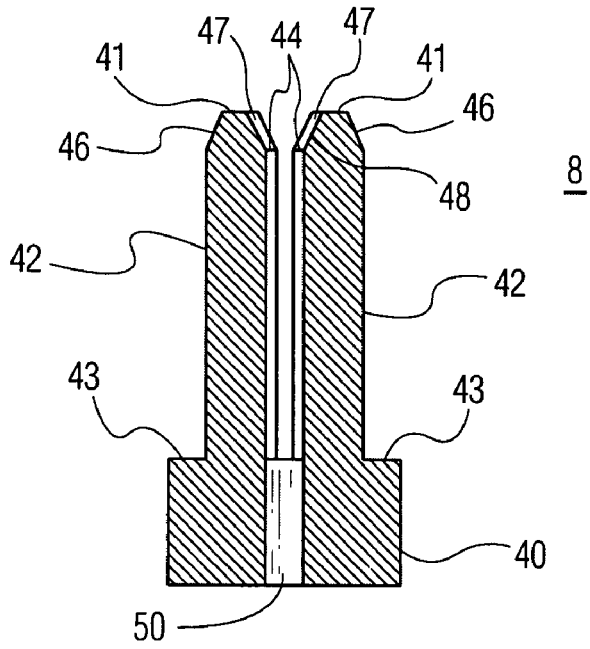
FIG. 5C is a cross-sectional view of the base member taken along 5C-5C of FIG. 5B.
Figure 5D:
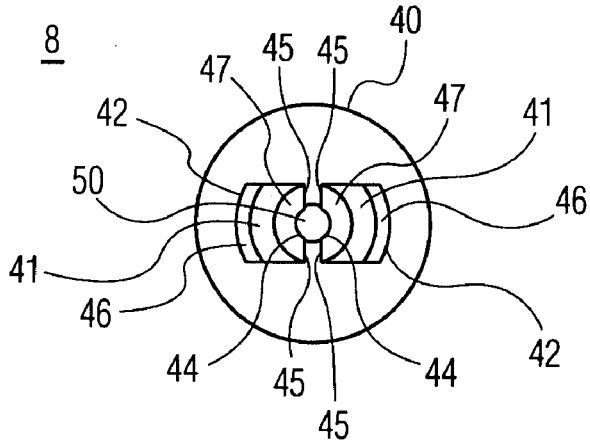
FIG. 5D is a top plan view of the base member of FIG. 5A.
Figure 5E:
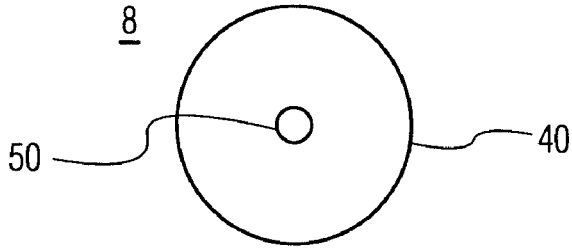
FIG. 5E is a bottom plan view of the base member of FIG. 5A.

The design of the base member 8 will now be described with reference to FIGS. 5A through 5E. The base member 8 includes a circular lowermost portion 40 from which two spaced apart opposing and vertically oriented contact receiving arms 42 extend. The interior opposing walls of the arms 42 are configured for receiving the opposing half-sections 33 of contact 6. The outside walls of the contact receiving arms 42 each have a radius, as best shown in FIG. 5D. The arms 42 also each include a longitudinal semicircular groove 44 on either side of flat wall portions 45. The grooves 44 are for receiving the semicircular outer wall portions or ribs 31 of the grooves 30 of the opposing half-sections 33 of contact 6. The flat wall portions 45 oppose the sidewall portions 37 of contact 6. The topmost outer and inner walls of the arms 42 include beveled portions 46, 48, respectively, on either side of the top portion 41. The expanded diameter circular lower portion 40 includes a centrally located through hole 50, as shown.

Figure 6:
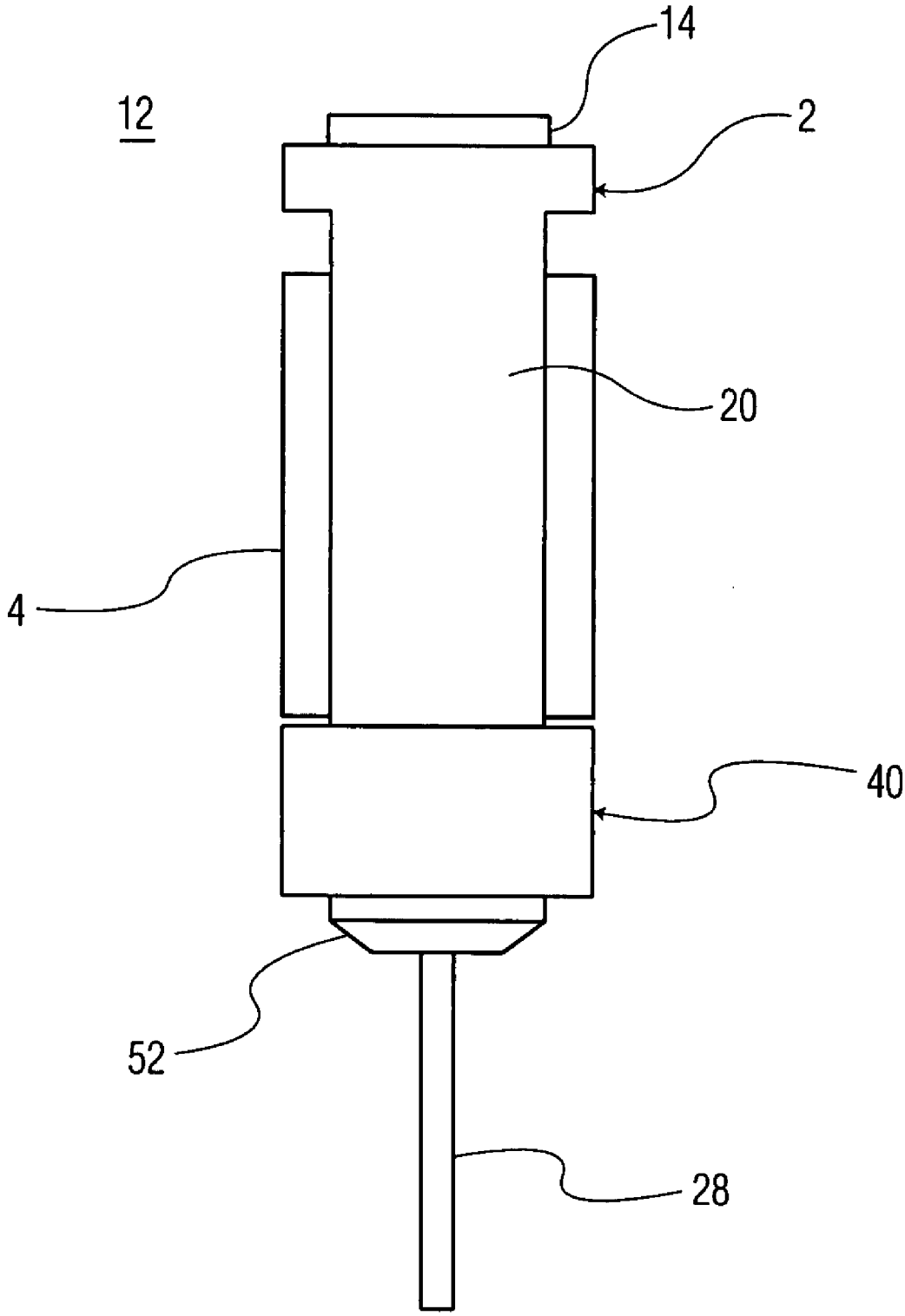
FIG. 6 is an assembled view of a female electrical connector assembly for an alternative embodiment of the invention utilizing an extended length base member to accommodate placement of the connector assembly within an elongated connector shell.

The length of the base member 8 is adjusted for either use in a vertical or horizontal RF connector port or shell 10. Typically, for use in a horizontal port shell 10, the base member 8 must be made longer than that for use in a vertical RF connector shell or port 10. In another embodiment of the invention, the base member 8, as shown in the configuration of 1C, is in this example designed or configured for use in a vertical RF connector shell or port 10. In FIG. 6, the base member 8, relative to the configuration of 1C, is lengthened for use in a horizontal RF connector shell or port 10 via the inclusion of an extended portion 52 from the lower circular portion 40, as shown. The base member 8, in this embodiment, is made from a single piece of dielectric plastic material, whereby any suitable plastic material that is soft enough to minimize resistance to bending can be utilized. In other words, the plastic material used for the base member 8 must be soft enough to permit the contact receiving arms 42 to move toward one another when an inwardly directed force is applied to each of the arms 42, as will be described in greater detail below, but have memory to return to or toward their rest position when the inward force is reduced.

The operation of the present coaxial connector will now be described. When the male pin or center conductor of a coaxial cable (not shown) is inserted into the contact assembly 12 contained within an RF conductor shell or port 10, the elastomeric sleeve 4 applies a constant radially inward pressure forcing the split halves 33 of the electrical contact 6 into contact with one another. The inward force or pressure is such that the male contact can be pushed into the female contact 6. The contact receiving arms 42 of the base member 8 are continually bent inwardly via the inward force provided by the elastomeric sleeve 4, for forcing the two halves 33 of the contact 6 to have their grooves 30 move into intimate mechanical contact with the male pin or center conductor of the coaxial cable for insuring very low electrical resistance therebetween. At the same time, almost 180° of mechanical contact between each half of the electrical contact 6 and the male pin or coaxial center conductor is maintained, for substantially the full length of the inserted male pin or conductor. In other words, each half-section 33 has their respective groove 30 surrounding almost half of the circumference for the length of the male pin or center conductor. In this manner, the lowest possible electrical resistance connection is maintained between the electrical contact 6 and the mating male pin or center conductor of a coaxial cable.

Note also that the preferred use of BeCu material for the female contact 6 provides a "memory." For example, when a large size male pin or center conductor is inserted, it will increase the radius of the grooves 30 to accommodate the size of the male pin or coaxial cable center conductor. Electrical contact 6 will still mechanically and electrically contact a substantial amount of surface of the male pin of coaxial center conductor. When the pin or conductor is removed from the connector assembly 12, the BeCu contact material of the grooves 30 will return to the original or rest radius thereof, thereby permitting contact 6 to perform as indicated for a smaller wire size relative to a previous larger wire size male pin or coaxial center conductor previously inserted therein. It should be noted that presently there are two common wire sizes for cable television systems in which the present coaxial connectors are expected to be used. The wire size for the center conductor of an RG-59 coaxial cable is 0.032 inch diameter, and for an RG-6 coaxial cable is 0.04 inch diameter.

In engineering prototypes for the present coaxial cable connector, electrical contact 6 consisted of 0.002 inch thick beryllium copper material, as previously indicated. More specifically, the material utilized in the prototype was Alloy 390HT manufactured by Brush Wellman. The groove 30 in each half 33 of the electrical contact 6 is formed around a 0.03 inch diameter wire, and each groove 30 has a semicircular cross-section, thereby permitting each to cover about half of the diameter or circumference surface of a male pin or conductor. The radius of the grooves 30 was 0.015 inch. As a result, when the two halves 33 of the contact 6 are opposing one another, with side-wing portions 37 in contact, the inside diameter of the circular groove 30 formed was 0.03 inch. It was determined through experimenting with the engineering prototype that the contact 6, upon receiving a 0.032 inch male pin, can readily expand to accommodate or receive the same. It was also found that the contact 6 can readily expand to accommodate a 0.040 inch male pin. Also, it was determined that when a 0.040 inch wire was removed, the contact 6 through the memory factor of BeCu material returns to its original previous dimension.

In the engineering prototype, the plastic material utilized for the cap member 2, base member 8, was UHMW Polyethylene.

In the engineering prototype, the cap 2 was 0.495 inch long, had a diameter of 0.185 inch in its topmost portion 14, and an outside diameter of 0.250 inch. The inside flat portions of its side members 20 were spaced at 0.175. The base 8 was 0.510 inch long, had 0.375 inch long contact receiving arms 42, a diameter of 0.25 inch in its lower portion 40, the latter's hole 50 having a diameter of 0.040 inch, the at-rest spacing between arms 42 was 0.020 inch, the grooves 44 had a radius of 0.020 inch, and the width of each arm 42 was 0.090 inch. Each half-section of female contact 6 was 0.435 inch long and 0.100 inch wide. The sleeve 4 was 0.30 inch long, had an inside diameter of 0.104 inch, and an outside diameter of 0.192 inch. These dimensions are not meant to be limiting, and are determined in accordance with the particular application for use of the present connector.

Although various embodiments of the invention have been shown and described, they are not meant to be limiting. Those of skill in the art may recognize certain modifications to these embodiments, which modifications are meant to be covered by the spirit and scope of the appended claims. For example, the present connector can be configured to be compatible with 75 ohm impedance cable television systems, but is not so limited.

What is claimed is:

1. A female coaxial cable electrical connector comprising:

a longitudinally split electrical contact including an opposing pair of half-sections each having semicircular interior walls configured for surrounding the circumference along the full length of a male pin or center conductor of a coaxial cable inserted therein; and a dielectric carrier configured both for mechanically securing in a central portion thereof said electrical contact, and for exerting an elastomerically generated yieldable radial force along the length of said pair of half-sections for forcing said interior walls thereof securely against and around the circumference of said male pin or center conductor to insure minimum electrical resistance therebetween.

2. A female coaxial electrical connector comprising:

an electrically conductive barrel or shell configured to mate with a male connector shell, said barrel including an internal circular cavity having an open top portion;

a female RF connector subassembly configured to be retained within the circular cavity of said barrel, said subassembly including:

a female contact consisting of electrically conductive material, said female contact including:

two parallel opposing elongated rectangularly shaped identical half-sections each including a front portion having a centrally located longitudinal semicircular groove with narrow side wing portions extending from opposing edges of the groove, and a back portion having a longitudinal rib as a result of said groove, and an end of an electrically conductive wire being both electrically and mechanically rigidly attached to a bottom portion of the grooves of each half-section, in a manner permitting the opposing side wing portions of each half-section to be brought together to form a circular pathway therebetween for receiving a male electrical pin or center conductor of a coaxial cable of a mating male RF coaxial connector;

a base member consisting of dielectric material, said base member including:

a circular lower portion having a centrally located through hole; and a pair of parallel opposing elongated spaced apart contact receiving arms extending upward from said lower portion, each arm being arc shaped and inwardly located from a side edge of said lower portion, each arm having an internal wall including a centrally located longitudinal radially shaped groove formed in a flat portion thereof, for receiving the side wing portions and rib of a half-section of said female contact, said arms being inwardly bendable with memory to return to a rest position, said wire of said contact extending through and out of the centrally located hole in said circular lower portion;

a tubular sleeve consisting of elastomeric material, said tubular sleeve being mounted over the contact receiving arms of said base member, for imparting an inwardly compressive force upon a substantial portion of the length of said arms, to bend said arms inward to maintain the opposing side wing portions of each half-section of said female contact in intimate contact with one another, in the absence of a male electrical pin or center conductor of a coaxial cable, whereas said sleeve is elastically yieldable to permit the insertion of said pin or center conductor concurrent with maintaining sufficient inward compressive force to cause the grooves of said female contact to surround and mechanically contact the full length of said pin or center conductor within said female contact to insure a continuous low resistance therebetween; and a cap member consisting of dielectric material, said cap member including:

a circular top portion having a centrally located through hole for receiving a male electrical pin or center conductor of a coaxial cable; and a pair of spaced apart downwardly projecting parallel opposing elongated relatively narrow side members extending from said circular top portion, each side member having arc-shaped outer walls and flat inner walls;

said cap member being mounted over said sleeve and underlying said base member, with said side members being oriented 90° from the contact receiving arms of said base member, and with free ends of said side members being proximate a top collar-like portion of said circular lower portion of said base member.

3. The connector of claim 2, wherein said barrel further includes:

a peened over lowermost portion for securely retaining said female RF connector subassembly therein.

4. The connector of claim 2, wherein said female electrical contact consists of a single piece of BeCu material.

5. The connector of claim 4, wherein said female electrical contact is 0.002 inch thick.

6. The connector of claim 4, wherein said two half-sections of said female electrical contact are each 0.435 inch long, have a 0.100 inch width, and have a 0.015 inch radius groove.

7. The connector of claim 2, wherein said two half-sections of said female electrical contact are formed from a rectangular sheet of BeCu material that is folded in half to provide the opposing two half-sections, a centrally located hole being provided in said sheet at a fold line between said half-sections for receiving an end portion of said electrically conductive wire.

8. The connector of claim 7, further including:

a portion of an end of said electrically conductive wire being located through said hole into lowermost portions of the opposing grooves of said half-sections of said electrical contact.

9. The connector of claim 2, wherein the side wing portions extending from the grooves of each of said half-sections of said electrical contact lie in the same vertical plane as the diameter of their associated groove.

10. The connector of claim 2, wherein each one of said base member, and said cap member consist of a single piece of UHMW polyethylene.

11. The connector of claim 2, wherein said base member further includes:

each one of said pair of receiving arms having a free end beveled on uppermost inner and outer side portions.

12. The connector of claim 2, wherein said cap member further includes:

an uppermost portion of said top portion being of reduced diameter relative to the following portion of said top portion, whereby a flat circular collar or ledge is formed therebetween.

13. The connector of claim 12, wherein said barrel or shell includes a lower portion peened over onto the lower end of the lower portion of said cap to retain said female RF connector subassembly securely within said barrel.

14. A method for providing a female RF coaxial electrical connector comprising the steps of:

forming a female contact from electrically conductive material to include two parallel opposing and spaced apart elongated rectangularly shaped identical half-sections, each having a centrally located longitudinal semicircular groove on a front portion, the groove further forming a longitudinal rib on a back portion, with narrow sidewall portions extending from opposing edges of the groove, whereby when the two half-sections are in contact along respective sidewall portions, a circular pathway is provided therebetween for receiving a male electrically conductive pin or a center conductor of a coaxial cable;

attaching an end portion of a length of electrically conductive wire to lowermost portions of the grooves of each contact half-section to insure a rigid mechanical and low resistance and/or impedance electrical connection therebetween;

forming a base member from dielectric material to have a pair of parallel opposing elongated spaced apart contact receiving arms extending from a circular lower portion, each of said arms having on inside flat wall portions a centrally located longitudinal arc shaped groove, each of said arms being inwardly spaced from said edges of said lower portion, thereby providing a circular collar-like ledge about an outer top portion of said lower portion;

inserting said female contact between said opposing arms of said base member, with each contact half-section having its rib within the groove of an associated arm, and its side wings proximate the flat wall portions of the associated arm, with said wire extending from said contact through a centrally located hole in said lower portion of said base member;

installing a tubular sleeve consisting of elastomeric material over free ends of said contact receiving arms, respectively, for bending said arms inward to force said female contact half-sections into constant contact with one another, in the absence of a male electrical pin or coaxial cable center conductor, said sleeve being elastically yieldable to permit the insertion of said pin or center conductor concurrent with maintaining sufficient inward bending force against said arms to constantly insure the grooves of each half-section surround and mechanically contact the full length of said pin or center conductor therebetween to insure a continuous mechanical and low resistance electrical connection therebetween;

forming a cap member from dielectric materials to include a circular top portion having a centrally located countersunk through hole for receiving a male electrical pin or coaxial cable center conductor, and to further include extending downward from said top portion a pair of spaced apart side members each having arc-shaped outer walls and flat inner walls; and mounting said cap member over said sleeve and underlying base member, with said side members being oriented 90° from the contact receiving arms of said base member, and with free ends of said side members being proximate said collar-like ledge of the lower portion of said base member.

15. The method of claim 14, wherein said female contact is formed from BeCu material.

16. The method of claim 14, wherein said base member and said cap member are each formed from UHMW polyethylene material.

17. The method of claim 14, wherein said tubular sleeve is formed from silicone material.

18. The method of claim 14, wherein tubular sleeve installing step includes the step of making a top portion of said tubular sleeve even with top portions of said contact receiving arms.

19. The method of claim 14, further including the steps of:

inserting an assembly of said base member, female contact, tubular sleeve, and cap member into an electrically conductive shell or barrel, a top opening of said female contact being exposed at an open top of said barrel; and peening over a lower portion of said barrel to retain said assembly therein.

20. The method of claim 19, further including the step of:

making the length of said assembly to substantially be equal to the interior length of said barrel.

* * * * *